US010167071B2

(12) United States Patent
Townsend et al.

(10) Patent No.: US 10,167,071 B2
(45) Date of Patent: Jan. 1, 2019

(54) DUAL DIFFERENTIAL RUDDER SYSTEM

(71) Applicant: CT Marine, INC, Portland, ME (US)

(72) Inventors: Christian Townsend, Portland, ME (US); Corning Townsend, Portland, MD (US)

(73) Assignee: Townsend Marine Design, Inc., Portland, ME (US)

( * ) Notice: Subject to any disclaimer, the term of this patent is extended or adjusted under 35 U.S.C. 154(b) by 0 days.

(21) Appl. No.: 15/933,616

(22) Filed: Mar. 23, 2018

(65) Prior Publication Data

US 2018/0273153 A1 Sep. 27, 2018

Related U.S. Application Data

(60) Provisional application No. 62/475,408, filed on Mar. 23, 2017.

(51) Int. Cl.
*B63H 25/38* (2006.01)
*B63H 25/06* (2006.01)

(52) U.S. Cl.
CPC ..... *B63H 25/38* (2013.01); *B63H 2025/066* (2013.01); *B63H 2025/387* (2013.01)

(58) Field of Classification Search
CPC ..... B63H 25/38
See application file for complete search history.

(56) References Cited

U.S. PATENT DOCUMENTS 2,276,163 A * 3/1942 Coolidge ..... B63H 25/38 114/163
2,916,005 A * 12/1959 Parsons ..... B63H 25/48 114/145 R
3,101,693 A * 8/1963 Schilling ..... B63H 25/383 114/163
3,872,817 A * 3/1975 Duryea ..... B63H 25/06 114/163
4,421,489 A * 12/1983 Van Veldhuizen ..... B60V 1/14 114/150
5,445,100 A * 8/1995 Finkl ..... B63H 25/38 114/163
2017/0081010 A1* 3/2017 Kuribayashi ..... B63H 25/383

* cited by examiner

*Primary Examiner* — Stephen P Avila
(74) *Attorney, Agent, or Firm* — Finnegan, Henderson, Farabow, Garrett & Dunner LLP

(57) ABSTRACT

There is disclosed a dual rudder system and method of improving the maneuvering ability and versatility of marine vehicles in navigable waters. A dual rudder steering assembly may be utilized in conjunction with a propeller of a marine vehicle. Moreover, multiple dual rudder steering assemblies may be utilized in conjunction with multiple propellers. A system for retrofitting existing marine vehicles with the disclosed devices is also disclosed, as well as a method of retrofitting existing marine vehicles with the steering system. Therefore, the disclosed steering system is compatible with pre-existing steering controls.

20 Claims, 15 Drawing Sheets

Prior Art

Prior Art

DUAL DIFFERENTIAL RUDDER SYSTEM

PRIORITY CLAIM

This application claims priority to U.S. Application No. 62/475,408, filed Mar. 23, 2017, the entire contents of which are herein incorporated by reference in their entirety.

TECHNICAL FIELD

The present disclosure generally relates to a device for improving the maneuverability and versatility of marine vehicles in navigable waters comprising a plurality of rudders coupled to a plurality of rudder stocks wherein the rudders may turn at different angles relative to one another. The present disclosure also relates to methods of using such devices on new marine vehicles, as well as methods of retrofitting existing marine vehicles to include such devices. The present disclosure also relates to kits or systems comprising such devices.

BACKGROUND

Numerous marine vehicles operate in shallow and restricted waters where maneuverability is a primary safety concern. Pushboats, Towboats, and Tugboats are some of the most common marine vehicles that navigate shallow waters and waters with strong currents. The maneuverability of a marine vehicle affects the safety of crew members, cargo, the marine vehicle itself, and the same within the vicinity of the marine vehicle. Furthermore, maneuverability is an integral component of the transportation efficiency of particular marine vehicles speed and fuel consumption. Because marine vehicles, such as tugboats, move large loads over great distances, they consume thousands of gallons of fuel in any operating year. Thus, by increasing the maneuverability and/or agility fuel consumption can also be decreased.

Presently the majority of tugboats rely on a conventional rudder system with a propulsion system forward of a single rudder or a single flapped rudder that is centered relative to the propulsion system. Many tugboats may have two propulsion systems, each having a single corresponding rudder that is flapped or unflapped. This current configuration has limited maneuverability, side thrust capabilities, and limited versatility as the rudder is large in both length and height relative to the propulsion system. These limitations, and others, limit significant numbers of marine vehicles from operating in shallow waters. These limitations also hinder the maneuverability and fuel efficiency of those marine vehicles.

Applicant believes at least one reason single rudder systems suffer from the aforementioned deficiencies is that in any one turning position a single rudder is only capable of diverting a portion of the jet stream. That is to say, that when the rudder pivots, a significant portion of the output power from the propulsion system (jet stream) will not make contact with the rudder. In turn, the output power from the propulsion system (jet stream) flows past the rudder without being fully utilized for maneuvering purposes. This phenomena explains at least one reason why embodiments in accordance with the present disclosure exhibit significantly higher "lift" relative to the prior art.

While some marine vehicles have a "dual rudder system" with a propulsion system forward of a pair of rudders these rudders each turn symmetrically with respect to one another in any one position. This type of configuration has limited maneuverability, side thrust capabilities, and limited versatility. The present disclosure is directed to a dual differential rudder system in which the rudders turn at different angles relative to one another. That is to say, the present disclosure is directed to navigation systems with two propulsion means, each propulsion means having a pair of rudders that turn at different angles relative to one another. Applicant has discovered, through extensive fluid dynamic testing and modeling, that embodiments in accordance with the present disclosure exhibit significant increases in maneuverability and fuel efficiency.

Applicant believes at least one reason the presently claimed dual differential rudder system is superior to conventional dual rudder systems is that the presently disclosed dual differential rudder system allows each rudder to turn at differential angles relative to one another. For example, when turning hard left the starboard side outermost rudder may turn at 36° while the interior most rudder may turn at 44°. That is to say, that when a dual differential rudder system pivots, each rudder turns at a different angle relative to the central neutral position. This unexpected phenomena explains at least one reason why embodiments in accordance with the present disclosure exhibit significantly higher "lift" relative to the prior art.

The present disclosure addresses one or more of the problems set forth above and/or other problems associated with conventional steering systems and rudders. The disclosed devices, methods, and systems are directed to overcoming one or more of the problems set forth above and/or other problems of the prior art, namely improving the maneuvering ability, fuel efficiency, and versatility of marine vehicles in navigable waters; particularly in shallow waters with strong currents.

SUMMARY

In one aspect, the present disclosure is directed to a rudder system for steering a marine vehicle, the rudder system comprising: two or more rudder components operably coupled to two or more bearing assemblies, wherein the bearing assemblies facilitate rotation of the rudder components and the rudder system exhibits lower drag and/or higher lift than a single rudder and/or a single flapped rudder.

In another aspect, the present disclosure is directed to a steering system for an existing marine vehicle, the steering system comprising: a retrofit rudder system comprising two or more rudder components coupled to two or more bearing assemblies, wherein the rudder components are chosen from a rudder tube assembly, rudder stocks, and combinations thereof.

In yet another aspect, the present disclosure is directed to a method of retro-fitting an existing vessel, such as a method of installing the disclosed steering system which comprising: removing and/or repairing at least a portion of pre-existing rudder system; reusing at least a portion of pre-existing steering system; installing new bearing assemblies and rudder tubes; attaching new rudder stocks and new rudders; and coupling steering control assemblies.

It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute a part of this specification, illustrate disclosed embodiments and, together with the description, serve to explain the disclosed embodiments. In the drawings.

DETAILED DESCRIPTION

Reference will now be made in detail to the disclosed embodiments, examples of which are illustrated in the accompanying drawings. Wherever convenient, the same reference numbers will be used throughout the drawings to refer to the same or like parts. However, a species of a genus may be referred to by the same reference number of the genus when describing the species in further detail.

FIGS. 1-5 are top perspectives and elevation perspectives of exemplary steering assemblies and rudder assemblies of a navigable marine vehicle. The various steering assemblies may have a starboard side and a port side of similar elements which may correspond to the starboard side and port side of a navigable marine vehicle. The starboard side will typically refer to the right side of the illustration while the port side will typically refer to the left side of the illustration. Wherever convenient, elements will be referred to by either the starboard side or the port side. However, like or similar elements may be referenced by grouping for ease of understanding and brevity.

Figure 1A:
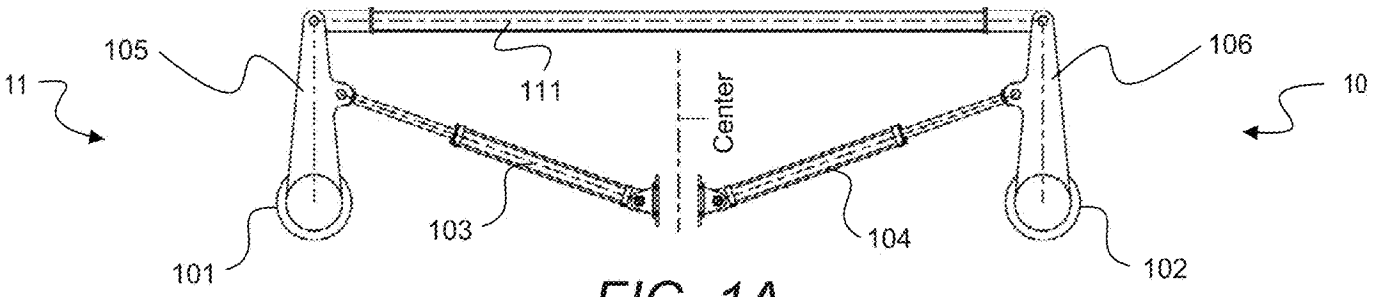
FIG. 1A is an exemplary plan view of typical pre-existing steering linkage.

Referring now to FIG. 1A is an exemplary plan view of an existing steering arrangement. The existing steering arrangement has a starboard steering control assembly 10 and a port steering control assembly 11. The steering control assemblies 10 and 11 may comprise a starboard control arm 106 and a port control arm 105 that are coupled by a connecting member bar 111 therebetween. The starboard control arm 106 is coupled to the starboard bearing assembly 102 and the port control arm 105 is coupled to the port bearing assembly 101. Similarly, the starboard control arm 106 is coupled to the starboard hydraulic assembly 104 and the port control arm 105 is coupled to the port hydraulic assembly 103.

The hydraulic assemblies 103 and 104 may be fixed to the marine vehicle in a secured center position by a freely rotating connection for symmetrical dispersion of forces. Similarly, the hydraulic assemblies 103 and 104 may be coupled to the control arms 105 and 106 by a freely rotating connection. The control arms 106 and 105 are operable by controlling the hydraulic assemblies 103 and 104 from a steering control room with the assistance of a steering cylinder, hydraulic storage unit, and hydraulic pumps (not illustrated). In this way, the hydraulic assemblies 103 and 104 may apply a controlled steering force against the control arms 106 and 105.

The control arms 106 and 105 may pivot with the assistance of the bearing assemblies 101 and 102 because of the steering force applied by the hydraulic assemblies 103 and 104. Furthermore, the control arms 106 and 105 may pivot together, at least partially, with the assistance of the connecting member bar 111 which may be coupled to the top portions of the control arms 105 and 106 by a freely rotating connection.

Figure 1B:
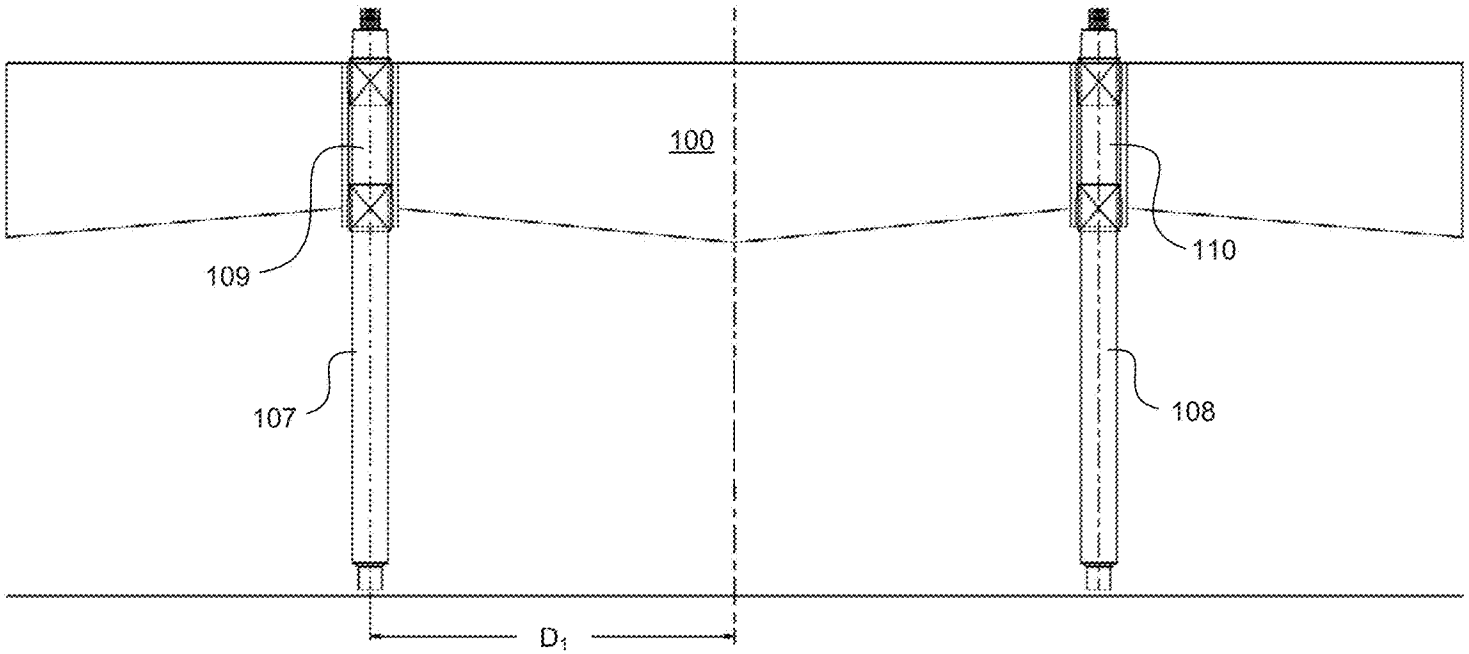
FIG. 1B is an exemplary elevation view of a typical pre-existing rudder assembly.

FIG. 1B is an exemplary elevation view of an existing rudder assembly. In the exemplary pre-existing embodiment, a starboard rudder tube assembly 110 and port rudder tube assembly 109 may be attached to the rearward hull 100 of a marine vehicle. The starboard rudder tube assembly 110 may house a starboard rudder stock 108 and the port rudder tube assembly 109 may house a port rudder stock 107. The rudder tube assemblies 110, 109 allow the respective rudder stocks 107, 108 to rotate during a maneuvering position.

For example, the hydraulic assemblies 103, 104 may apply a force against the control arms 105, 106 thereby causing rotation along the rudder bearing assemblies 101, 102. The rudder bearing assemblies 101, 102 may in turn cause the rudder stocks 107, 108 to rotate. The rotation of the rudder stocks 107, 108 may in turn cause the respective rudders to rotate.

Although rudders are not illustrated in FIGS. 1A and 1B, it should be understood that a starboard rudder may be operably coupled to the starboard rudder stock 108 and a port rudder may be operably coupled to the port rudder stock 107. Furthermore, the centerline of each rudder may coincide with the centerline of each respective rudder stock 107, 108. Moreover, each rudder stock 107, 108 and each rudder may be equidistant from the centerline of a marine vehicle at an approximate distance $D_1$ with necessary accounting for rotation during steering maneuvers. $D_1$ may be approximately 5' to 10' from the centerline of the marine vehicle, such as from 6' to 8'. In one embodiment, $D_1$ may be approximately 6'6" from the centerline of the marine vehicle.

Figure 2A:
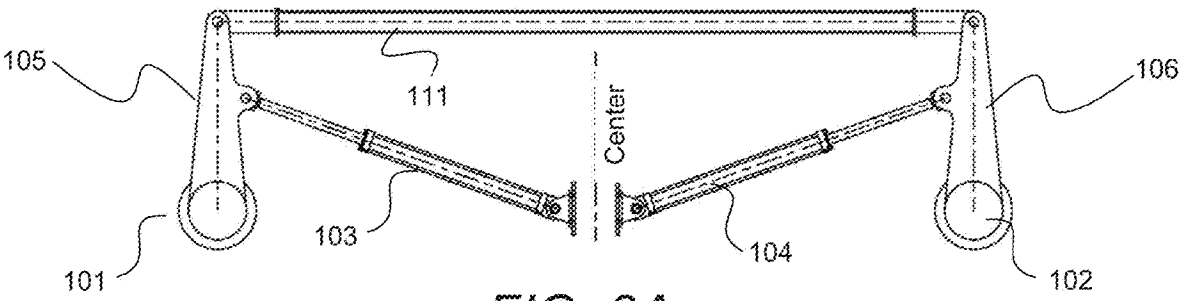
FIG. 2A is an exemplary plan view of the pre-existing steering linkage of FIG. 1 with modifications, consistent with disclosed embodiments.
Figure 2B:
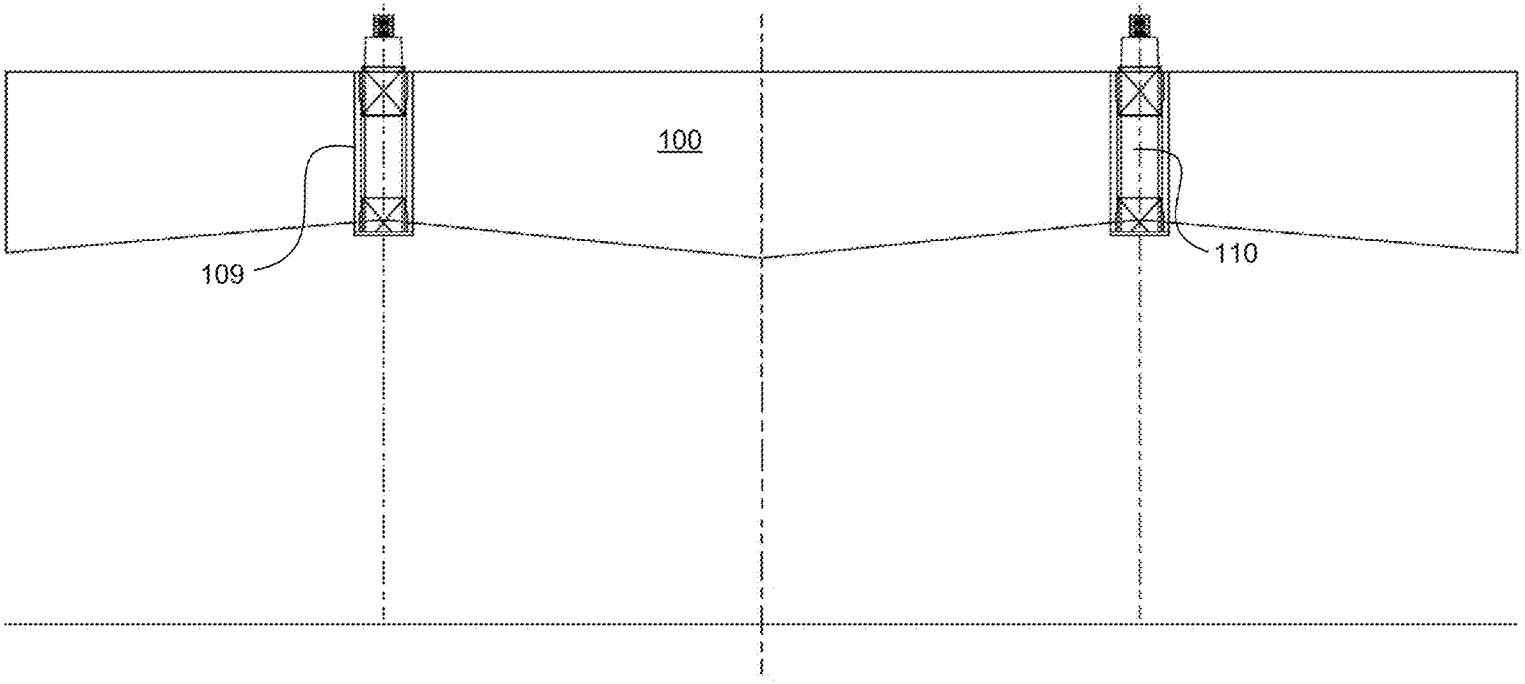
FIG. 2B is an exemplary elevation view of the pre-existing rudder assembly of FIG. 1 with modifications, consistent with disclosed embodiments.

FIG. 2A is an exemplary plan view of the existing steering linkage of FIG. 1A and FIG. 2B is an exemplary elevation view of the existing rudder assembly of FIG. 1B, with modifications. In FIG. 2B, the existing rudder tube assemblies 109, 110 and the existing rudder stocks 107, 108 are trimmed and capped. They may be trimmed at an appropriate location such as the bottom shell. For example, the shell plating may be closed using similar insert plating with an appropriate thickness, such as ½ to 1 inch, more specifically ¾ of an inch, where the exterior of the rearward hull 100 is flush. In at least one embodiment, a thrust washer(s) may be installed in conjunction with the shell plating. In other embodiments, thicker or thinner plating may be used that negate the installation of a thrust washer.

Figure 3A:
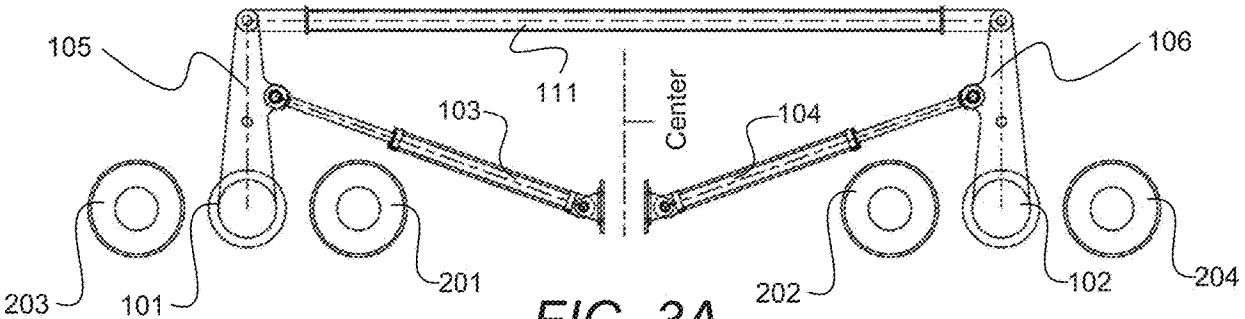
FIG. 3A is an exemplary plan view of the installation of a portion of a modified steering control assembly, consistent with disclosed embodiments.

FIG. 3A is an exemplary plan view of a portion of a modified steering control assembly alongside the existing steering linkage of FIGS. 1A and 2A. In FIG. 3A four new bearing assemblies 201, 202, 203, and 204 are installed. New port inside bearing assembly 201 may be installed at a distance $D_2$ from the centerline of a marine vehicle. Similarly, new starboard inside bearing assembly 202 may be installed at a distance $D_2$ from the centerline of a marine vehicle.

In the exemplary embodiment, the new inside bearing assemblies 201, 202 are installed at equal distances from the centerline of a marine vehicle. For example, $D_2$ may be approximately 3' to 8' from the centerline of the marine vehicle, such as from 4' to 6'. In one embodiment, $D_2$ may be a distance on the order of 4'7" from the centerline of a marine vehicle as may be appropriate for a tugboat. However, it should be understood that $D_2$ may be any distance as may be commensurate with the particular marine vehicle at issue.

New port outside bearing assembly 203 may be installed at a distance $D_3$ from the centerline of a marine vehicle. Similarly, new starboard outside bearing assembly 204 may be installed at a distance $D_3$ from the centerline of a marine vehicle. In the exemplary embodiment, the new outside bearing assemblies 203, 204 may be installed at equal distances from the centerline of a marine vehicle. For example, $D_3$ may be approximately 6' to 12' from the centerline of the marine vehicle, such as from 8' to 10'. In one embodiment, $D_3$ may be a distance on the order of 8'5" from the centerline of a marine vehicle. In this way, the axis of rotation of each of port side bearing assemblies 203 and 201 may be spaced equidistant from the axis of rotation of port side bearing assembly 101 e.g., 1'7".

Moreover, distance $D_3$ may be greater than distance $D_2$. However, it should be understood that $D_2$ may be any distance as may be commensurate with the particular marine vehicle at issue. The disclosed dimensions herein are not to be construed as limiting but rather are exemplary. Similarly, the new starboard outside and inside bearing assemblies 204, 202 may be equidistant from the existing starboard side bearing assembly 102. In this way, the axis of rotation of each of starboard side bearing assemblies 202 and 204 may be spaced equidistant from the axis of rotation of port side bearing assembly 101 e.g., 1'7".

Figure 3B:
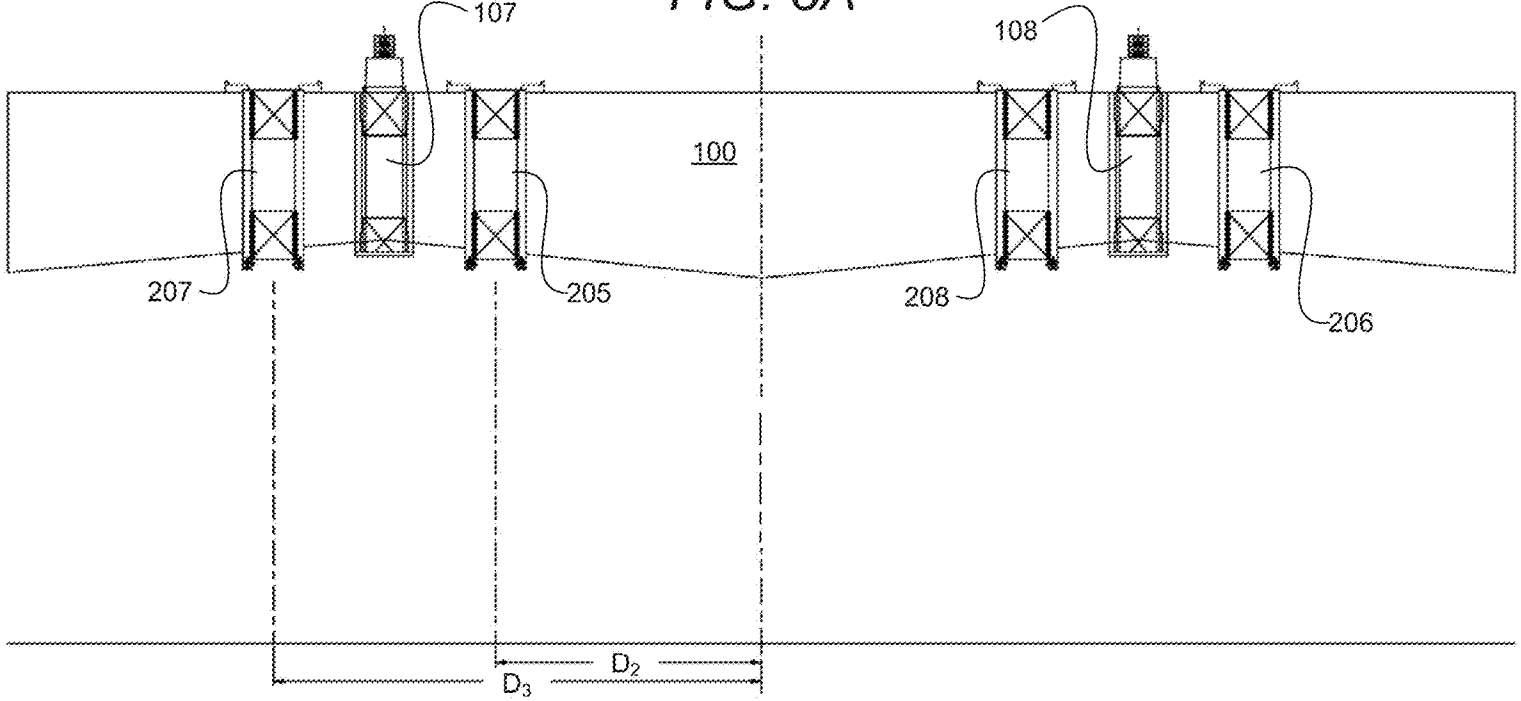
FIG. 3B is an exemplary elevation view of the installation of a portion of a modified rudder assembly, consistent with disclosed embodiments.

FIG. 3B is an exemplary elevation view of the installation of a portion of a rudder assembly alongside the modified rudder assembly of FIG. 2B. In the exemplary embodiment, four new rudder tube assemblies 205, 206, 207, and 208 are installed. New port inside rudder tube assembly 205 may be installed at a distance $D_2$ from the centerline of a marine vehicle. Similarly, new starboard inside rudder tube assembly 208 may be installed at a distance $D_2$ from the centerline of a marine vehicle. In the exemplary embodiment, the new inside rudder tube assemblies 201, 202 may be installed at equal distances from the centerline of a marine vehicle, such as previously provided. For example, $D_2$ may be a distance on the order of 4'7" from the centerline of a marine vehicle. However, it should be understood that $D_2$ may be any distance as may be commensurate with the particular marine vehicle at issue.

New port outside rudder tube assembly 207 may be installed at a distance $D_3$ from the centerline of a marine vehicle marine vehicle. Similarly, new starboard outside rudder tube assembly 206 may be installed at a distance $D_3$ from the centerline of a marine vehicle. In the exemplary embodiment, the new outside rudder tube assemblies 206, 207 may be installed at equal distances from the centerline of a marine vehicle, such as previously provided. For example, $D_3$ may be a distance on the order of 8'5" from the centerline of a marine vehicle. Moreover, distance $D_3$ may be greater than distance $D_2$. Further, the new port outside and inside rudder tube assemblies 207, 205 may be equidistant from the existing port side rudder tube assembly 107. Similarly, the new starboard outside and inside rudder tube assemblies 206, 208 may be equidistant from the existing starboard side rudder tube assembly 108.

It should be understood that distances $D_2$ and $D_3$ may be any distance. However, in at least one embodiment distances $D_2$ and $D_3$ are chosen based on the location of the existing bearing assemblies 101, 102 and the existing rudder tube assemblies 107,108. Furthermore, the distances of the outside bearing assemblies 203, 204 and the outside rudder tube assemblies 207, 206 may correspond such that they are operable. Similarly, the distances of the inside bearing assemblies 201, 202 and the inside rudder tube assemblies 205, 208 may correspond such that they are within the same plane and are thus coordinated to be operable with one another.

Figures 4A, 4B:
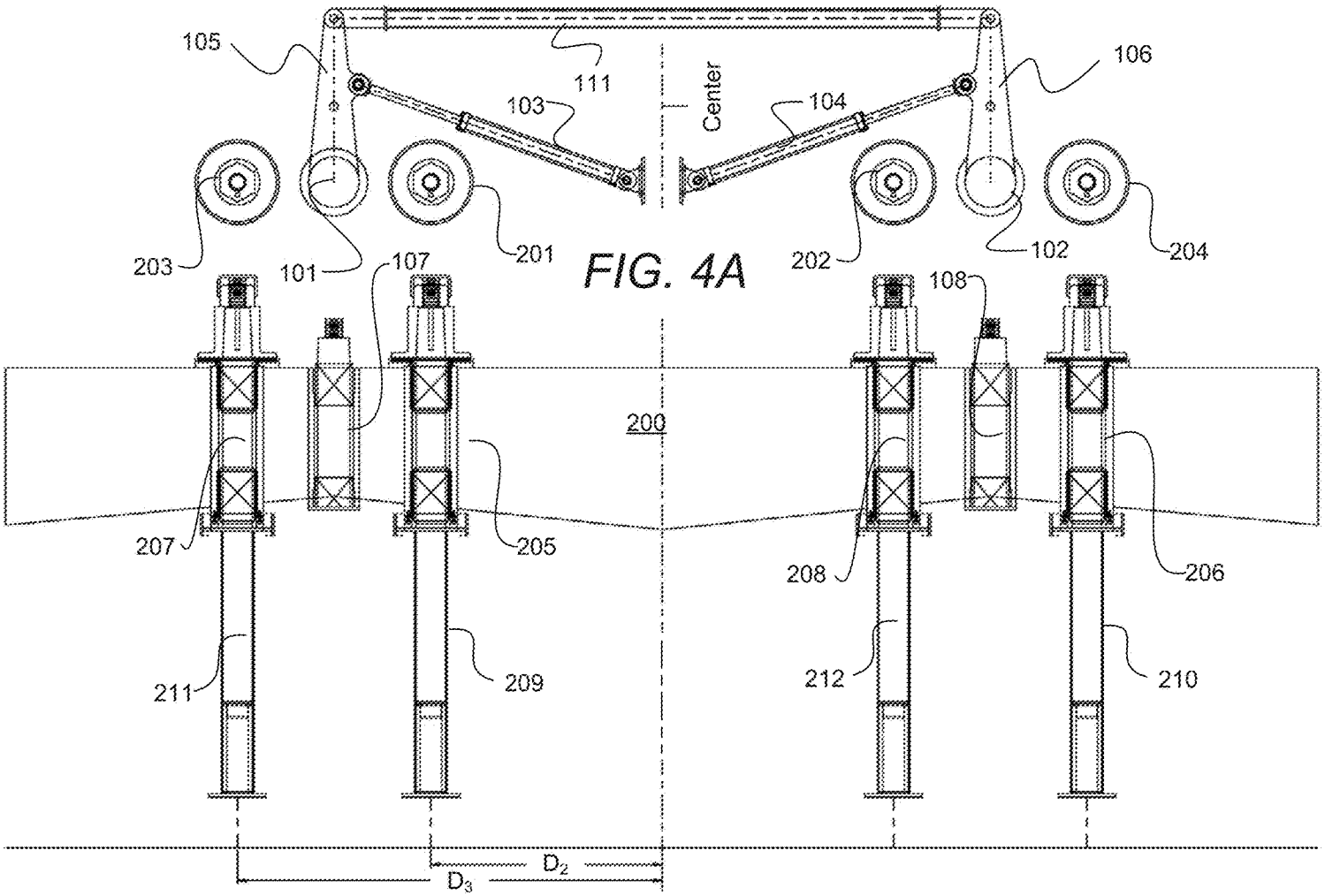
FIG. 4A is an exemplary plan view of the installation of another portion of a modified steering control assembly, consistent with disclosed embodiments.
FIG. 4B is an exemplary elevation view of the installation of another portion of a modified rudder assembly, consistent with disclosed embodiments.

FIG. 4A is an exemplary plan view of a portion of a steering control assembly, as may be consistent with FIG. 3A and FIG. 4B is an exemplary elevation view of another portion of a rudder assembly, consistent with disclosed embodiments. In FIG. 4B four new rudder tubes 209, 210, 211, and 212 are installed. The port outside rudder tube 211 is coupled to the port outside rudder tube assembly 207 and the port inside rudder tube 209 is coupled to the port inside rudder tube assembly 205. Similarly, the starboard outside rudder tube 210 is coupled to the starboard outside rudder tube assembly 206 and the starboard inside rudder tube 212 is coupled to the starboard inside rudder tube assembly 208. The rudder tubes 209, 210, 211, and 212 may be coupled to and contained within an interior space of the rudder tube assemblies 205, 206, 207, and 208. Further, the rudder tubes 209, 210, 211, and 212 may be coupled with the assistance of connecting hardware. Moreover, the rudder tube assemblies 205, 206, 207, and 208 allow uninhibited rotation of the rudder tubes 209, 210, 211, and 212. It should be understood that rudder tubes 209, 210, 211, and 212 may further couple to rudders (not illustrated).

Figures 5A, 5B:
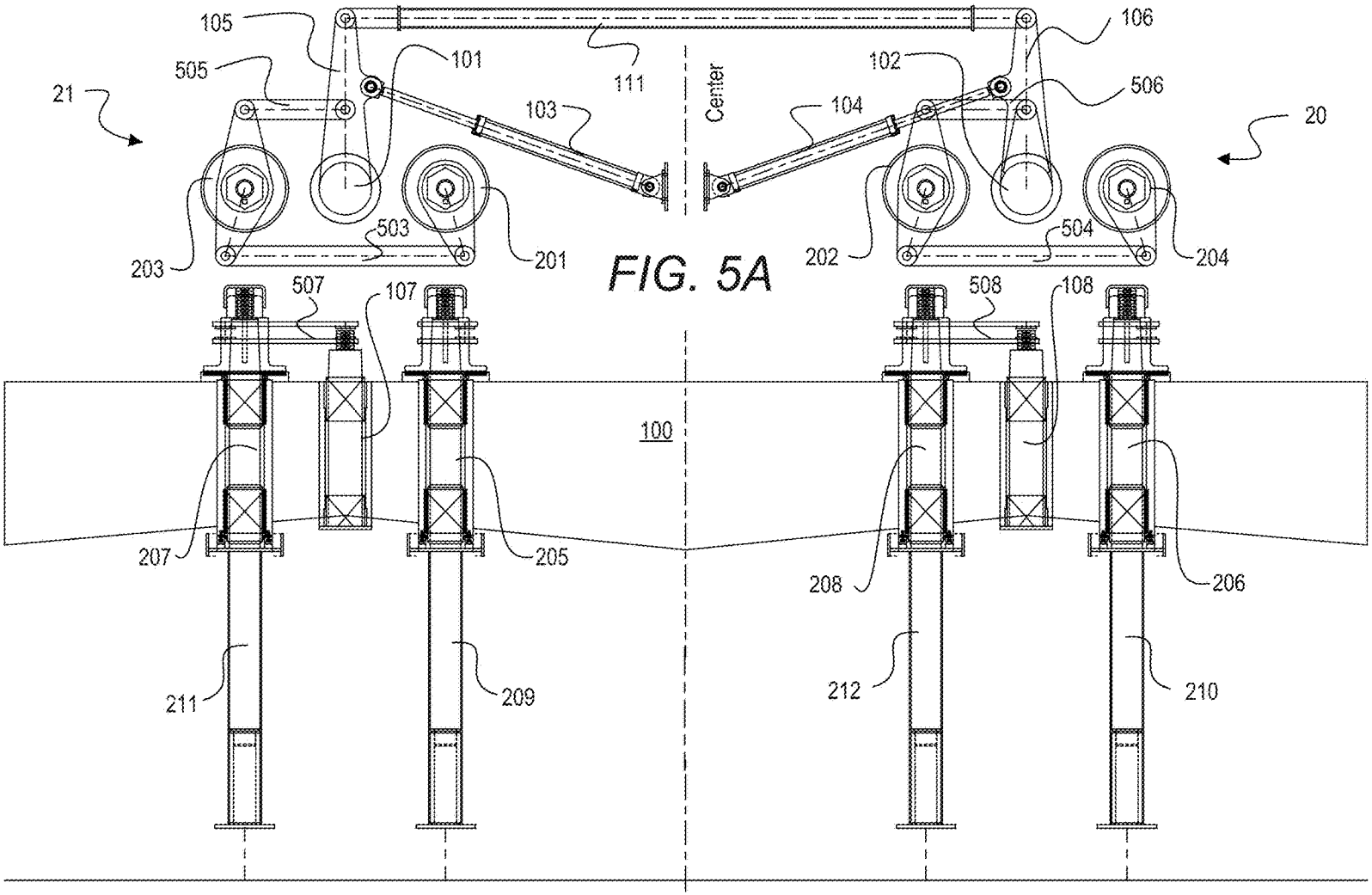
FIG. 5A is an exemplary plan view of the installation of another portion of a modified steering control assembly, consistent with disclosed embodiments.
FIG. 5B is an exemplary elevation view of the installation of another portion of a modified rudder assembly, consistent with disclosed embodiments.

FIG. 5A is an exemplary plan view of the installation of another portion of a steering control assembly. In FIG. 5A a port side upper linkage assembly bar 505 may be coupled to a port side control arm 105. The port side upper linkage assembly bar 505 may be equal in length to the distance between the axis of rotation of bearing assembly 203 and the center line of port side control arm 105. Stated another way, the port side upper linkage assembly bar 505 may be equal in length to the distance between the axis of rotation of pre-existing bearing assembly 101 and bearing assembly 203. As illustrated in the exemplary embodiment of FIG. 5A, the port side upper linkage assembly bar 505 may project away from the center line of a navigable marine vehicle. In the exemplary embodiment of FIG. 5A, the port side control arm 105 may be an existing control arm that is modified to allow a connecting element of upper linkage assembly bar 505 to couple to it.

The connecting element(s) may be coupled such that only substantially lateral forces from the port side control arm 105 may be transferred along the port side upper linkage assembly bar 505. In turn, the lateral forces may be transferred through the port outside bearing assembly 203 by connecting element(s). The port side outside bearing assembly 203 may be coupled to a lower linkage assembly bar 503 by connecting element(s). The port side lower linkage assembly bar 503 may be coupled to the port side outside bearing assembly 203 and the port side inside bearing assembly 201 by connecting elements. The connecting elements may be on opposite ends of the port side lower linkage assembly bar 503 to facilitate transfer of lateral, or at least substantially lateral, forces.

Moreover, the port side lower linkage assembly bar 503 may be greater in length than the shortest distance between the axis of rotation of port side outside bearing assembly 203 and the axis of rotation of port side inside bearing assembly 201. As illustrated, the upper linkage assembly bar is equal, or substantially equal, in length to the shortest distance between the axis of rotation of port side inside bearing assembly 201 and the centerline of port side control arm 105, such as from 1' to 3'. In the exemplary embodiment, this is approximately 1'7". Because the port side lower linkage assembly bar 503 is greater in length than the distance between the axis of rotation of port side outside bearing assembly 203 and the axis of rotation of port side inside bearing assembly 201; and, the upper linkage assembly bar is equal, or substantially equal, in length to the shortest distance between the axis of rotation of port side inside bearing assembly 201 and the centerline of port side control arm 105 a pair of rudders (not illustrated) will turn at differential angles. Hence, they may be said to be differential.

In at least one embodiment, the connecting elements may be similar to a pin or dowel connection that prevents rotational transfer of forces thereby allowing only substantially lateral force transfer. Therefore, in at least one embodiment, when the port side hydraulic arm 103 applies a force to the port side control arm 105, lateral forces are transferred through the upper and lower linkage assemblies 505 and 503 which in turn cause a rotation of the port side rudder stocks 209, 211 and their corresponding rudders (not illustrated).

A starboard side upper linkage assembly bar 506 may be coupled to a starboard side control arm 106. In the exemplary embodiment of FIG. 5A, the starboard side control arm 106 may be an existing control arm that is modified to allow a connecting element(s) of starboard upper linkage assembly bar 506 to couple to it. The starboard side upper linkage assembly bar 506 may be equal in length to the distance between the axis of rotation of bearing assembly 202 and the center line of starboard side control arm 106. Stated another way, the starboard side upper linkage assembly bar 506 may be equal in length to the shortest distance between the axis of rotation of pre-existing bearing assembly 102 and bearing assembly 202. As illustrated in the exemplary embodiment of FIG. 5A, the starboard side upper linkage assembly bar 505 may project towards the center line of a navigable marine vehicle. The connecting element(s) may be coupled such that only substantially lateral forces from the starboard side control arm 106 may be transferred along the starboard side upper linkage assembly bar 506. In turn, the lateral forces may be transferred through the starboard outside bearing assembly 204 by connecting element(s). The starboard outside bearing assembly 204 may be coupled to a lower linkage assembly bar 504 by connecting element(s). The starboard side lower linkage assembly bar 504 may be coupled to the starboard outside bearing assembly 204 and the starboard inside bearing assembly 202 by connecting elements. The connecting elements may be on opposite ends of the starboard lower linkage assembly bar 504 to facilitate transfer of lateral, or at least substantially lateral, forces.

Moreover, the starboard side lower linkage assembly bar 504 may be greater in length than the shortest distance between the axis of rotation of starboard side outside bearing assembly 204 and the axis of rotation of starboard side inside bearing assembly 202. As illustrated, the upper linkage assembly bar is equal, or substantially equal, in length to the shortest distance between the axis of rotation of starboard side inside bearing assembly 202 and the centerline of starboard side control arm 105. Because the port side lower linkage assembly bar 504 is greater in length than the distance between the axis of rotation of starboard side outside bearing assembly 204 and the axis of rotation of starboard side inside bearing assembly 202; and, the upper linkage assembly bar is equal, or substantially equal, in length to the shortest distance between the axis of rotation of starboard side inside bearing assembly 202 and the centerline of starboard side control arm 106 a pair of rudders (not illustrated) will turn at differential angles. Hence, they may be said to be differential.

Additionally, because the port side upper linkage assembly bar projects away from a centerline of a navigable marine vehicle, and the starboard side upper linkage assembly bar 506 projects towards the centerline of a navigable marine vehicle the pair of port side rudders and pair of starboard side rudders (not illustrated) will turn in the same way. Moreover, such a configuration is beneficial when modifying existing steering elements to transition to the disclosed dual differential rudder system.

Moreover, the port side control arm 105, port side linkage assemblies 503, 505, port side bearing assemblies 101, 201, 203, and port side hydraulic arm 103 may substantially complete a port side steering control assembly 21. Likewise, the starboard side control arm 106, starboard side linkage assemblies 504, 506, starboard side bearing assemblies 202, 204, and starboard side hydraulic arm 104 may substantially complete a starboard side steering control assembly 20. The port side and starboard side steering control assemblies 20, 21 may be coupled by a connecting member bar 111 to facilitate symmetrical and even force distribution throughout the steering control assemblies 20 and 21. In at least one embodiment, the steering control assemblies 20, 21 may be a combination of aforementioned elements that may be new, pre-existing, or modified pre-existing elements. In other embodiments, the steering control assemblies 20, 21 may be entirely new original manufacture elements.

In FIG. 5B an exemplary elevation view of a rudder assembly, consistent with FIG. 4B may be illustrated. A port side tiller arm 507 may be coupled to a connecting element of a port side rudder tube 107 (that was previously trimmed) and a connecting element of a port side outside rudder tube 211. Similarly, a starboard side tiller arm 508 may be coupled to a connecting element of a starboard side rudder tube 108 (that was previously trimmed) and a connecting element of a starboard inside rudder tube 210.

Figures 5C, 5D:
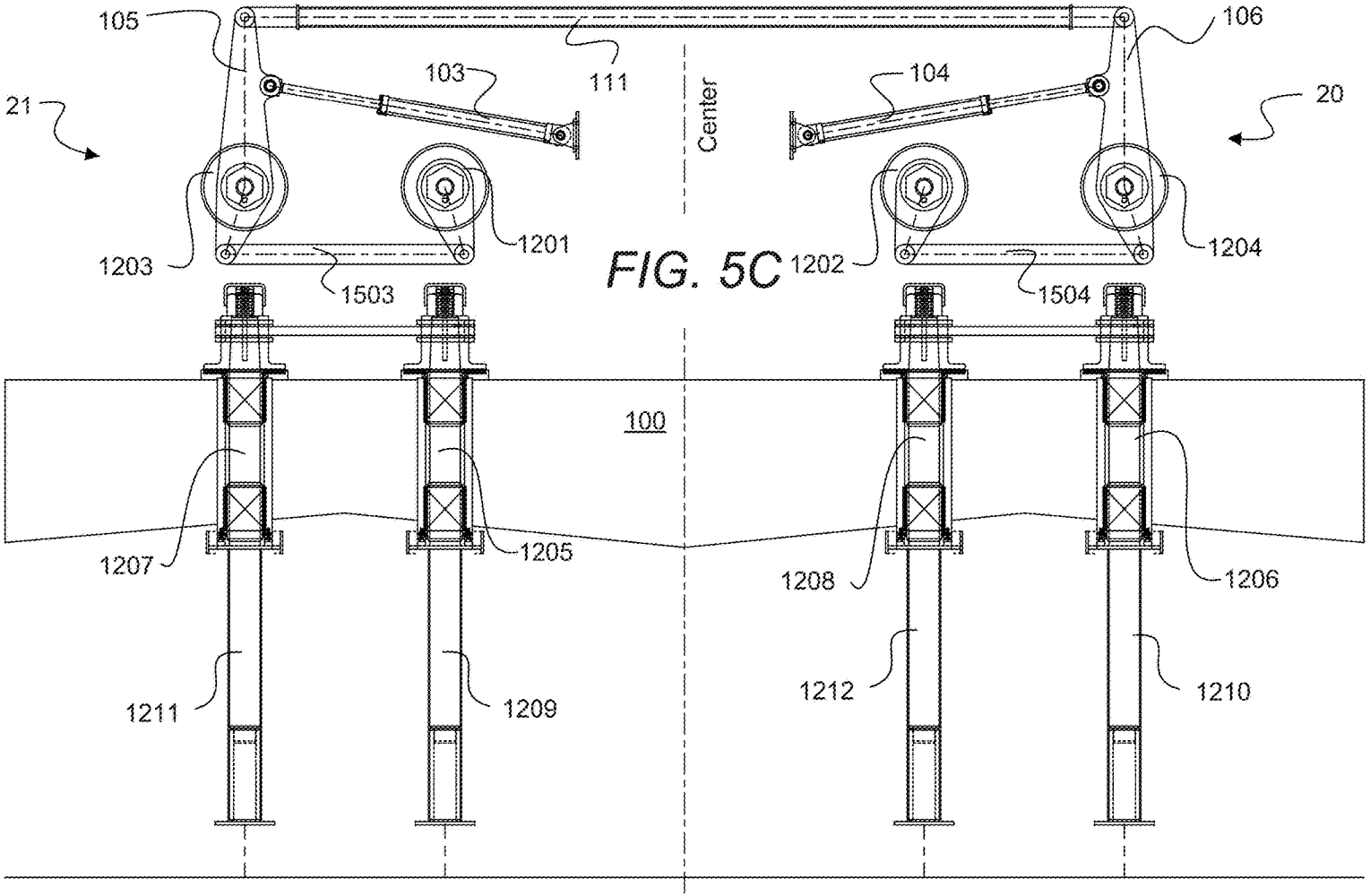
FIG. 5C is an exemplary plan view of a new construction steering control assembly, consistent with disclosed embodiments.
FIG. 5D is an exemplary elevation view of a new construction steering control assembly, consistent with disclosed embodiments.

In FIG. 5C an exemplary plan view of a new construction dual differential rudder assembly, may be illustrated. The exemplary new dual differential rudder assembly, may be similar to the previously disclosed embodiments. Therefore similar elements may have substantially similar features; explanations; and reference characters.

In FIG. 5D an exemplary elevation view of a new construction dual differential rudder assembly, may be illustrated. The exemplary new dual differential rudder assembly, may be similar to the previously disclosed embodiments. Therefore similar elements may have substantially similar features; explanations; and reference characters.

In exemplary new construction embodiments, such as those in FIG. 5C, an upper linkage assembly bar (See 505 of FIG. 5A) is not necessary. As illustrated, the port side outside bearing assembly 1203 may be coupled to a lower linkage assembly bar 1503 by connecting element(s). The port side lower linkage assembly bar 1503 may be coupled to the port side outside bearing assembly 1203 and the port side inside bearing assembly 1201 by connecting elements. The connecting elements may be on opposite ends of the port side lower linkage assembly bar 1503 to facilitate transfer of lateral, or at least substantially lateral, forces.

Moreover, the port side lower linkage assembly bar 1503 may be greater in length than the shortest distance between the axis of rotation of port side outside bearing assembly 1203 and the axis of rotation of port side inside bearing assembly 1201. Because the port side lower linkage assembly bar 1503 is greater in length than the shortest distance between the axis of rotation of port side outside bearing assembly 1203 and the axis of rotation of port side inside bearing assembly 1201 a pair of rudders (not illustrated) will turn at differential angles. Hence, they may be said to be differential.

In exemplary new construction embodiments, such as those In FIG. 5C, an upper linkage assembly bar (See 506 of FIG. 5A) is not necessary. As illustrated, the starboard outside bearing assembly 1204 may be coupled to a lower linkage assembly bar 1504 by connecting element(s). The starboard side lower linkage assembly bar 1504 may be coupled to the starboard outside bearing assembly 1204 and the starboard inside bearing assembly 1202 by connecting elements. The connecting elements may be on opposite ends of the starboard lower linkage assembly bar 1504 to facilitate transfer of lateral, or at least substantially lateral, forces.

Moreover, the starboard side lower linkage assembly bar 1504 may be greater in length than the shortest distance between the axis of rotation of starboard side outside bearing assembly 1204 and the axis of rotation of starboard side inside bearing assembly 1202. As illustrated, the upper linkage assembly bar is equal, or substantially equal, in length to the shortest distance between the axis of rotation of starboard side inside bearing assembly 1202 and the centerline of starboard side control arm 1105. Because the port side lower linkage assembly bar 1504 is greater in length than the distance between the axis of rotation of starboard side outside bearing assembly 1204 and the axis of rotation of starboard side inside bearing assembly 1202 a pair of rudders (not illustrated) will turn at differential angles. Hence, they may be said to be differential.

In FIG. 5D four rudder tubes 1209, 1210, 1211, and 1212 are installed. The port outside rudder tube 1211 is coupled to the port outside rudder tube assembly 1207 and the port inside rudder tube 1209 is coupled to the port inside rudder tube assembly 1205. Similarly, the starboard outside rudder tube 1210 is coupled to the starboard outside rudder tube assembly 1206 and the starboard inside rudder tube 1212 is coupled to the starboard inside rudder tube assembly 1208. The rudder tubes 1209, 1210, 1211, and 1212 may be coupled to and contained within an interior space of the rudder tube assemblies 1205, 1206, 1207, and 1208. Further, the rudder tubes 1209, 1210, 1211, and 1212 may be coupled with the assistance of connecting hardware. Moreover, the rudder tube assemblies 1205, 1206, 1207, and 1208 allow uninhibited rotation of the rudder tubes 1209, 1210, 1211, and 1212. It should be understood that rudder tubes 1209, 1210, 1211, and 1212 may further couple to rudders (not illustrated).

Figure 5E:
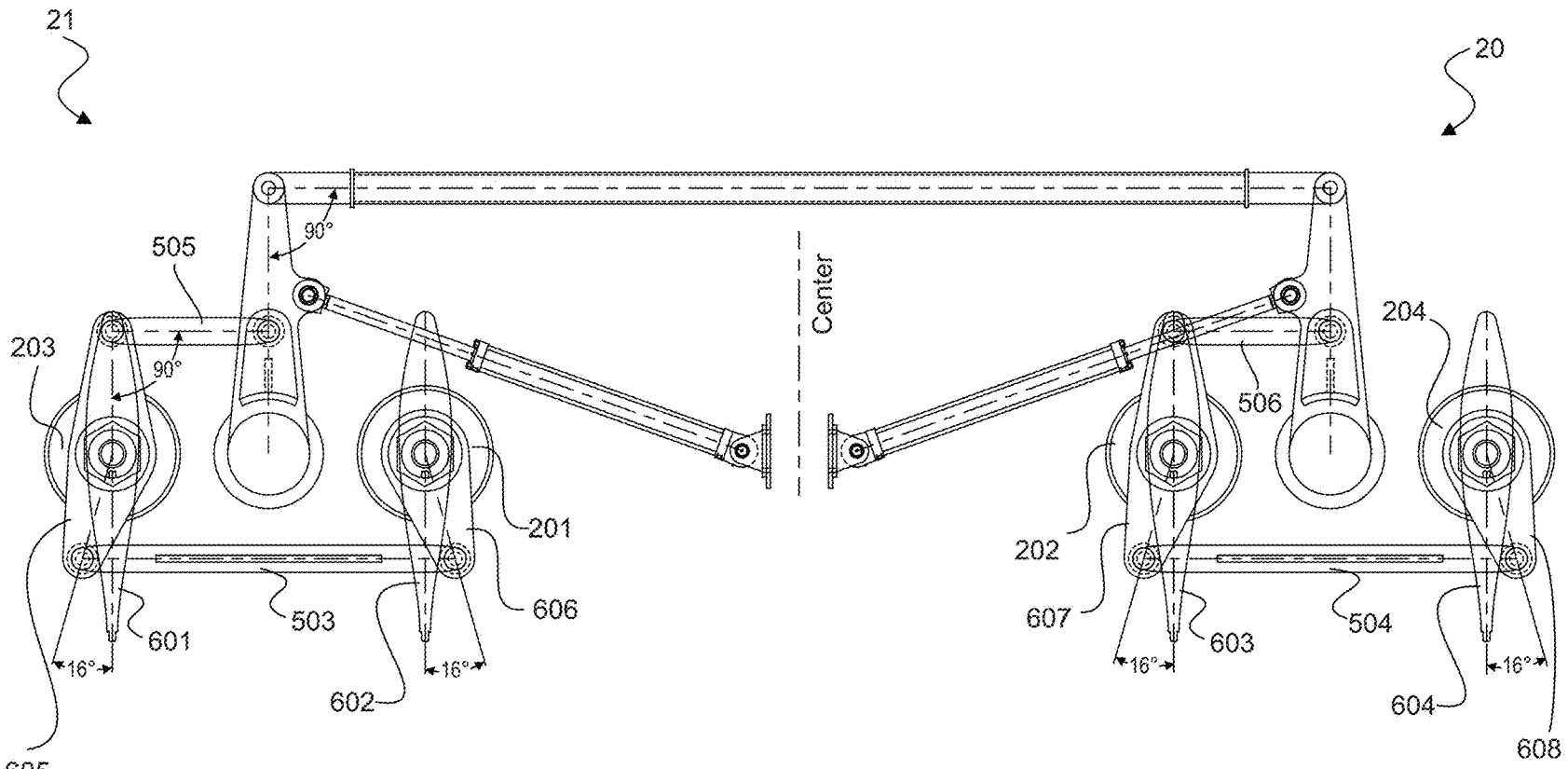
FIG. 5E is an exemplary plan view of a modified rudder assembly in the neutral position, overlaid on top of rudders in the neutral position, consistent with disclosed embodiments.

In FIG. 5E, an exemplary plan view of a dual differential rudder system is disclosed. The exemplary dual differential rudder system may be similar to the previously disclosed embodiment of FIG. 5A. Therefore similar elements may have substantially similar features; explanations; and reference characters. Additionally, some reference characters of previously explained elements are removed for ease of understanding.

FIG. 5E illustrates a dual differential rudder system in the neutral position. As shown in FIG. 5E, two pairs of rudders are disclosed. A pair of port side rudders 601, 602 and a pair of starboard side rudders 603, 604 are disclosed. In the exemplary embodiment, the port side upper linkage assembly bar 505 is coupled to linkage assembly member 605. Linkage assembly member 605, may be understood as connecting upper linkage assembly bar 505 and lower linkage assembly bar 503. As illustrated, the lower portion of port side outer linkage assembly member 605 is shown with a center line projection from the axis of rotation of bearing assembly 203 to the connecting element of the lower linkage assembly bar 503. Moreover, the center line of the lower portion of port side outer linkage assembly member 605 is offset from the centerline of the outside port side rudder 601, such as from about 10° to 20° or from about 15° to 18°, such as about 16°. Stated another way, it is angled away from the centerline of the navigable marine vehicle.

As illustrated, port side inner linkage assembly member 606 is shown with a center line projection from the axis of rotation of bearing assembly 201 to the connecting element of the lower linkage assembly bar 503. Moreover, the center line of the port side inner linkage assembly member 606 is offset from the centerline of the inside port side rudder 602 toward the centerline of the navigable marine vehicle, such as from about 10° to 20° or from about 15° to 18°, such as about 16°, i.e., it is angled toward the centerline of the navigable marine vehicle.

As illustrated in FIG. 5E, the starboard side upper linkage assembly bar 506 is coupled to interior linkage assembly member 607. As illustrated, starboard side interior linkage assembly member 607 is shown with a lower portion that has a center line projection from the axis of rotation of bearing assembly 202 to the connecting element of the lower linkage assembly bar 504. Moreover, the center line of the lower portion of the starboard side interior linkage assembly member 607 is offset from the centerline of the inside starboard side rudder 603 toward the centerline of the navigable marine vehicle, such as from about 10° to 20° or from about 15° to 18°, such as about 16°, i.e., it is angled towards the centerline of the navigable marine vehicle.

As illustrated, starboard side outer linkage assembly member 608 is shown with a center line projection from the axis of rotation of bearing assembly 204 to the connecting element of the lower linkage assembly bar 504. Moreover, the center line of the starboard side outer linkage assembly member 608 is offset from the centerline of the inside port side rudder 602 away from the centerline of the navigable marine vehicle, such as from about 10° to 20° or from about 15° to 18°, such as about 16°, i.e., it is angled away from the centerline of the navigable marine vehicle.

Figure 5F:
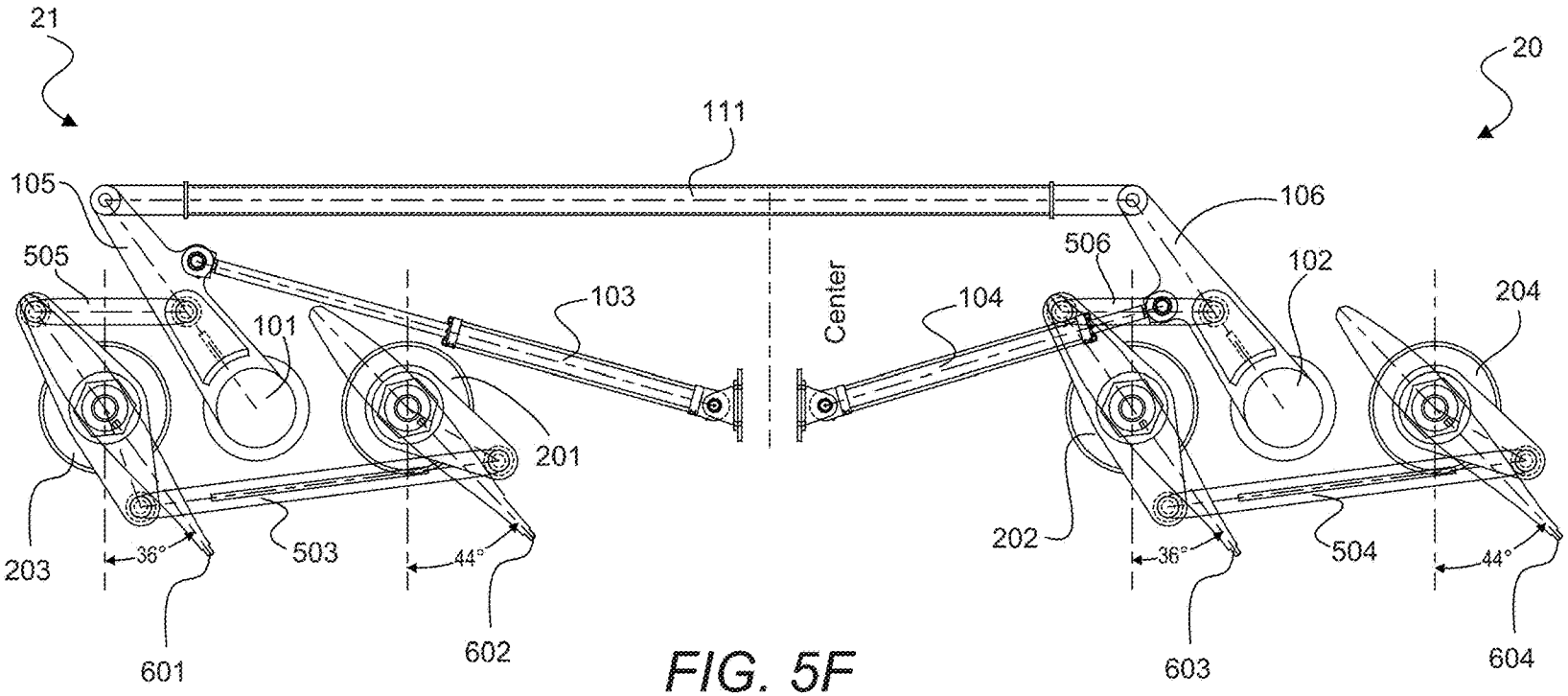
FIG. 5F is an exemplary plan view of a modified rudder assembly in the hard left position; overlaid on top of rudders in the hard left position, consistent with disclosed embodiments.

FIG. 5F illustrates the dual differential rudder system in the hard left position. FIG. 5F illustrates how the rudders 601 and 602, turn at different angles relative to one another and how the pair of rudders 603 and 604 turn in the same way as the pair of rudders 601, 602. Those with skill in the art, will appreciate that the same concepts will apply when the dual differential rudder system is in the hard right position. Likewise, those with skill in the art will appreciate that the same concepts apply to all of the interstitial positions between hard left and hard right.

As illustrated, port side hydraulic arm 103 is extended and applies a force to the port side control arm 105. In turn, lateral forces are transferred through the upper and lower linkage assemblies 505 and 503 which in turn cause a rotation of the outside port side rudder 601 to about 36° from neutral position and the interior port side rudder 602 about 44° from neutral position. Those with skill in the art will appreciate that the outside and interior port side rudders turn at different angles relative to one another because of the offset configuration of linkage assembly members 605, 606 and because the length of lower linkage assembly bar 503 is greater than the shortest distance between the axis of rotation of bearing assembly 203 and bearing assembly 201.

As illustrated, starboard side hydraulic arm 104 is retracted and pulls the starboard side control arm 106. In turn, lateral forces are transferred through the upper and lower linkage assemblies 506 and 504 which in turn cause a rotation of the inside starboard side rudder 603 to about 36° from neutral position and the outside port side rudder 604 about 44° from neutral position. Those with skill in the art will appreciate that the outside and interior starboard side rudders turn at different angles relative to one another because of the offset configuration of linkage assembly bar members 607, 608 and because the length of lower linkage assembly bar 503 is greater than the shortest distance between the axis of rotation of bearing assembly 202 and bearing assembly 204.

In this way, the outside port side rudder 601 behaves the same way as the inside starboard side rudder 603. Likewise, the inside port side rudder 602 behaves the same way as the outside starboard side rudder 604.

Table 1 illustrates an exemplary embodiment's turning angles of each of rudders 601, 602, 603, and 604 in various turning positions. Those with skill in the art will appreciate the below table represents exemplary angles and similar angles may be provided that are different but still fall within the scope of this disclosure.

TABLE 1

| Position | Rudder 601 | Rudder 602 | Rudder 603 | Rudder 604 |
|---|---|---|---|---|
| Hard Left | 36° | 44° | 36° | 44° |
| Center Left | 18° | 22° | 18° | 22° |
| Neutral | 0° | 0° | 0° | 0° |
| Center Right | 22° | 18° | 22° | 18° |
| Hard Right | 44° | 36° | 44° | 36° |

Figure 6:
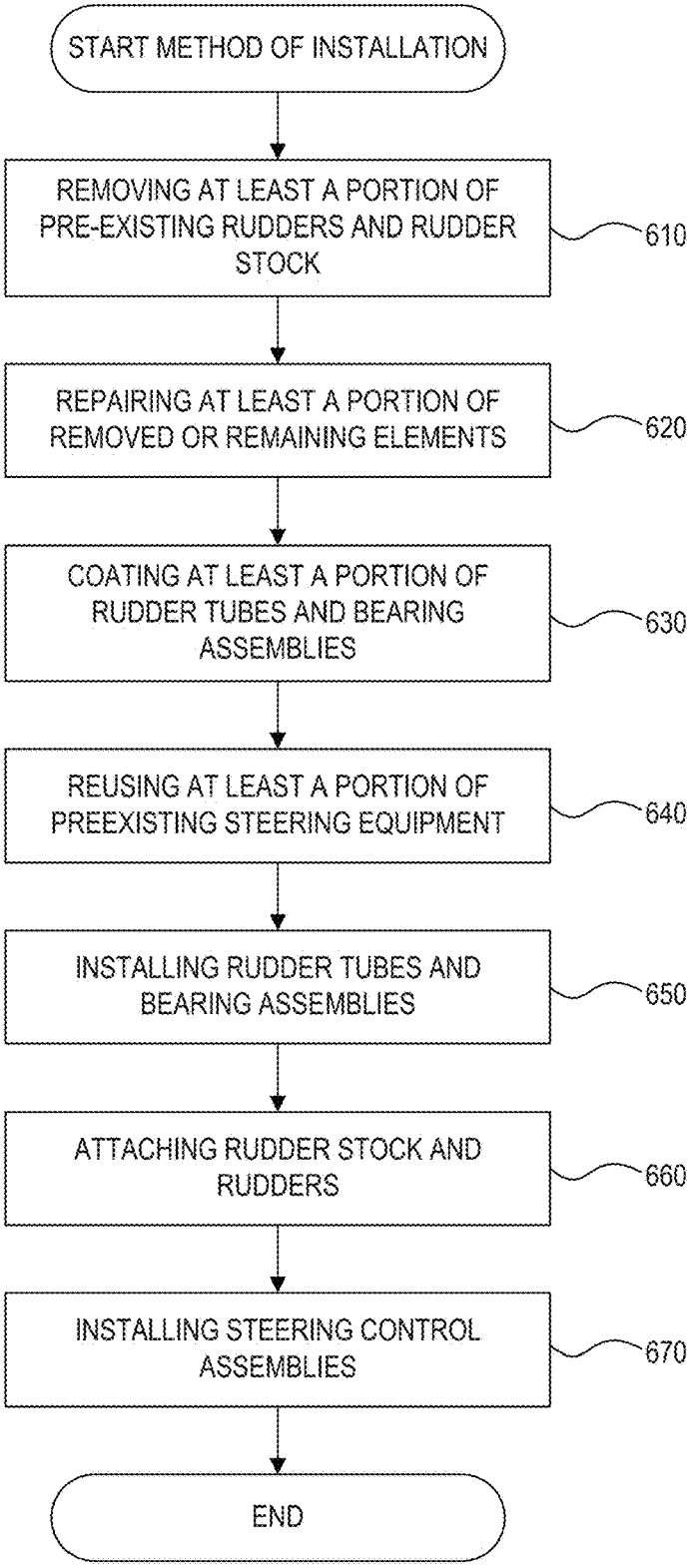
FIG. 6 is an exemplary flow chart of an exemplary method of installation of a steering control assembly and a rudder assembly.

In FIG. 6 a flow chart of a method of installation of a steering system conversion apparatus is illustrated. First, at step 610 pre-existing rudders and rudder stock may be removed as illustrated by FIG. 2B. In some embodiments, the pre-existing elements will be completely removed whereas in others at least a portion of the pre-existing rudders and rudder stock will not be removed. For example, the pre-existing rudder tubes and lower bearings may be trimmed at the bottom shell.

Next, at step 620 at least a portion of the removed or remaining pre-existing elements may be repaired and or modified as illustrated by FIG. 2B. For example, the pre-existing rudder tubes and lower bearings may be plated at the location where trimming occurred with an insert. The insert may correspond to a location where the exterior of the hull of a marine vehicle is flush. Additionally, the control arms may be modified to allow coupling of an upper linkage assembly bar as illustrated in FIG. 5A. Further, holes may be trimmed in the hull of a marine vehicle for the installation of bearing assemblies as illustrated in FIG. 3A.

Next, at optional step 630 at least a portion of rudder tubes and bearing assemblies may be coated with a resilient material. The resilient material may prevent corrosion of the rudder tubes and bearing assemblies. Next, at optional step 640 at least a portion of the pre-existing steering equipment may be re-used. For example, the trimmed elements may be removed, cleaned, coated, and reinstalled. Similarly, the control arms and hydraulics and differential linkage may be serviced in place or may be removed and overhauled completely. Next, at step 650 rudder tubes and bearing assemblies may be installed as illustrated in FIGS. 3A and 3B. The bearing assemblies may be installed within the hull of a marine vehicle such that at least a portion of the bearing assemblies are visible from the rear of a marine vehicle. In at least one embodiment, four new bearing assemblies and four new rudder tubes may be installed alongside two pre-existing bearing assemblies and two pre-existing rudder tubes. A pair of bearing assemblies may straddle each pre-existing bearing assembly at an equidistant location. Similarly, a pair of rudder tubes may straddle each pre-existing rudder tube assembly at an equidistant location.

Next, at step 660 rudder stocks may be installed within the rudder tubes in coordination with the bearing assemblies as illustrated in FIGS. 4A and 4B. In at least one embodiment, four new rudder stocks may be installed within the four new rudder tubes. The rudder tubes may couple to the rudder stock and allow the rudder stock to rotate. For example, the rudder stock may rotate within a space within the rudder tubes. Next, at step 670 at least one steering control assembly and at least one tiller arm may be installed as illustrated by FIGS. 5A and 5B.

In some embodiments, two steering control assemblies interlinked by a connecting member may be installed. The tiller arms may couple at least one set of modified pre-exiting rudder stock and tube to at least one set of new rudder stock and tube as illustrated by FIG. 5B. In at least one embodiment, a starboard tiller arm may couple a pre-existing rudder tube and modified rudder stock to a starboard outside rudder tube and rudder stock. Similarly, a port tiller arm may couple a pre-existing rudder tube and modified rudder stock to a port outside rudder tube and rudder stock.

Generally referring to the aforementioned steps, the existing steering cylinder, hydraulic storage unit, hydraulic pumps, and other unnamed ancillary steering equipment may be re-used. For example, the controls in the pilot house, the steering engine etc. may remain substantially unaltered. This aspect is highly advantageous as the method of conversion outlined throughout this disclosure may be performed quickly, efficiently, and in a cost effective manner.

The steering conversion apparatus may impart a superior steering force at all angles, speeds, and propeller RPMS as compared to the prior pre-existing steering apparatus. Furthermore, the modification may require less rudder angle to perform a similar maneuver as compared to the prior steering apparatus. Further still, the steering conversion method may allow for a greater number of rudders than the original configuration. Therefore, the steering conversion method may increase the navigability of a marine vehicle.

In at least one exemplary embodiment, the new rudders may be smaller than the original rudders in length, width, and height. The smaller rudders may allow the marine vehicle to safely navigate shallow waters. Furthermore, smaller rudders may allow the propeller and propeller shaft to be removed without the need to drop the steering rudders. This aspect may reduce down time and shipyard costs over the life of a marine vehicle.

Figure 7:
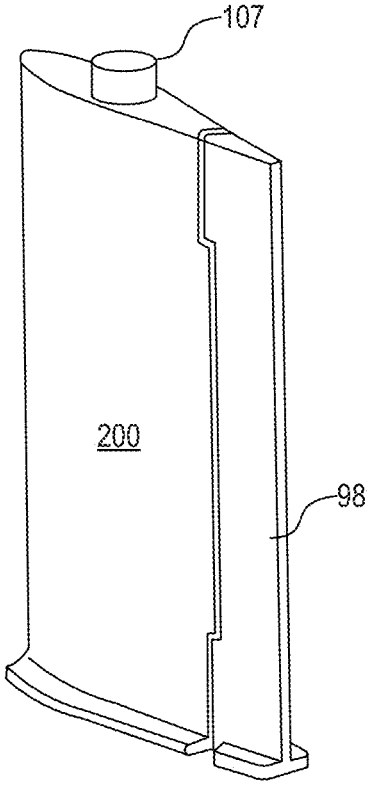
FIG. 7 is an exemplary prior art single flapped rudder assembly.
Figure 8A:
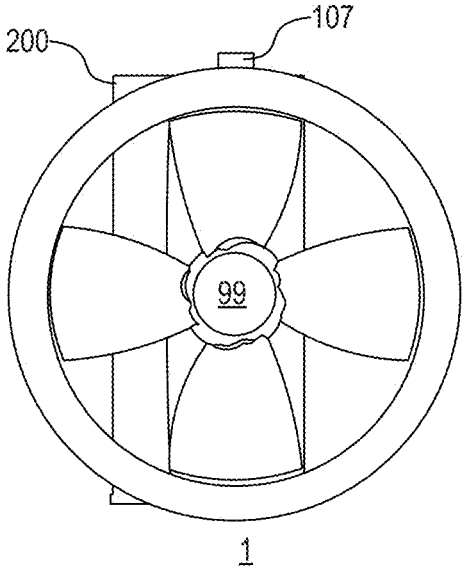
FIG. 8A Prior Art
FIGS. 8A and 8B are exemplary prior art first and second views of a single flapped rudder assembly.
Figure 8B:
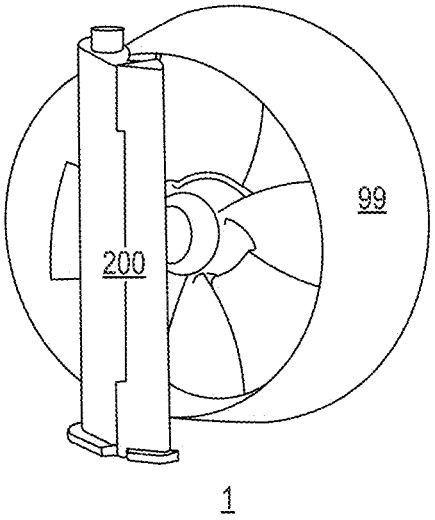

In. FIG. 7 a prior art single flapped rudder is illustrated. The single flapped rudder 200 may be a typical rudder assembly of common tugboats. The exemplary single flapped rudder 200 is a pre-existing single flapped rudder 200 with a rear flap 98. Further, the single flapped rudder 200 is operably connected to a pre-existing port side rudder stock 107 (see FIG. 1). FIGS. 8A and 8B illustrate a first and second view of a prior art single flapped rudder system 1 of a port side of a marine vehicle. It should be understood that numerous marine vehicles may utilize a starboard side single flapped rudder system (not illustrated) and a port side single flapped rudder system 1 that are substantially similar.

The exemplary single flapped rudder system 1 may consist of a pre-existing propeller 99, pre-existing rudder 200, and pre-existing port rudder stock 107 (see FIG. 1). FIGS. 8A and 8B may illustrate the typical rudder and propeller configuration of numerous marine vehicles. Moreover, FIGS. 8A and 8B may illustrate a pre-existing rudder assembly that may be modified by a conversion method, kit, or apparatus as disclosed throughout this application.

Figure 9:
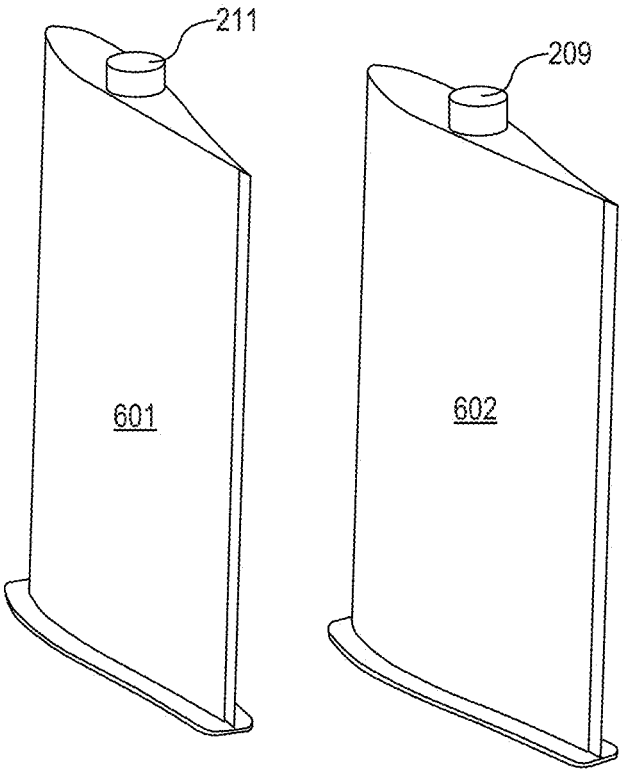
FIG. 9 is an exemplary dual rudder assembly, consistent with disclosed embodiments.

In FIG. 9 a pair of port side rudders is illustrated. The pair of rudders may consist of an inside rudder 602 and an outside rudder 601. The inside rudder 602 may be coupled to an inside rudder stock 209 (see FIG. 5). Similarly, the outside rudder 601 may be coupled to an outside rudder stock 211 (see FIG. 5).

Figure 10A:
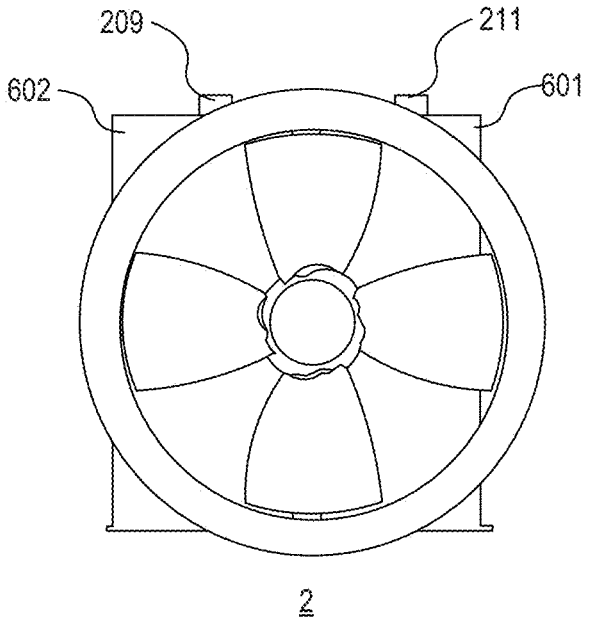
FIGS. 10A and 10B are exemplary first and second views of a dual rudder assembly, consistent with disclosed embodiments.
Figure 10B:
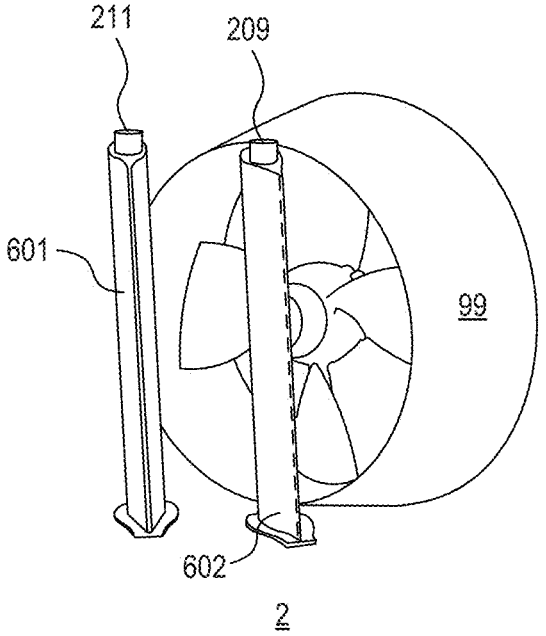

FIGS. 10A and 10B illustrate a first and second view of a dual rudder system 2 of a port side of an exemplary marine vehicle, such as the embodiment of FIG. 5E. It should be understood that an exemplary marine vehicle may have a starboard dual rudder system (not illustrated) and a port side dual rudder system 2 that are substantially similar.

The exemplary dual rudder system 2 may consist of a pre-existing propeller 99 and a pair of rudders 601, 602 that are coupled to a pair of rudder stocks 209, 211. Moreover, the exemplary dual rudder system 2 may utilize a portion of pre-existing parts such as the pre-existing steering controls and hydraulics. As illustrated in FIG. 10B the port side inside rudder 602 is turned more than the outside port side rudder 601, similar to the embodiment of FIG. 5E.

Figure 11A:
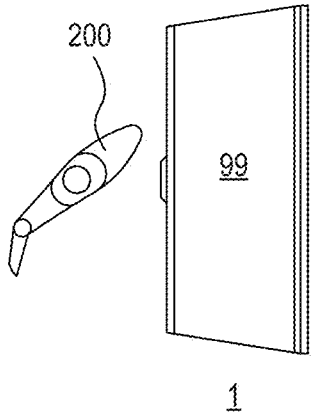
FIG. 11A is an exemplary top down view of a prior art single flapped rudder assembly.
Figure 11B:
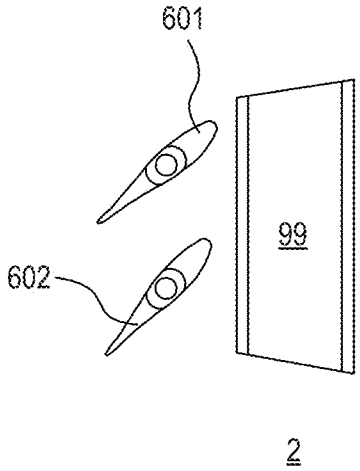
FIG. 11B is an exemplary top down view of a double rudder assembly.

FIG. 11A is a top down view of a single flapped rudder system and FIG. 11B is a top down view of a dual rudder system. The single flapped rudder system 1 may be typical of tugboats and other marine vehicles. The dual rudder system 2 may be a converted system or it may be the original equipment manufacture of a marine vehicle. Moreover, the dual rudder system 2 may have superior steering ability and efficiency of that compared to a single flapped rudder system 1. Further, the rudders 601, 602 of a dual rudder system 2 may be smaller in height, width, and length than a single flapped rudder 200 of a single flapped rudder system 1. However, the total surface area of rudders 601, 602 of a dual rudder system 2 may be greater and therefore may enable a greater agility, maneuverability, and overall transportation efficiency. The dual rudder system 2 may be considered as consisting of two rudders, the angle of each which may be varied in relation to the other. In at least one embodiment, a primary rudder of the dual rudder system 2 may be oriented at an angle of 40°, 20°, and 10°, and a secondary of the dual rudder system 2 may be oriented at an angle of 47.5°, 22.5°, and 10.4°, respectively.

Referring to the figures generally, it should be understood that distances and spatial relationships may be modified without deviating from the contemplated scope of this disclosure. For example, a first marine vehicle may call for the installation of rudder tubes and rudder stock at an equidistant location from pre-existing rudder tubes whereas a second marine vehicle may call for the installation of rudder tubes and stock at differing distances and locations from pre-existing rudder tubes. Further still, a third marine vehicle may call for the addition of a single rudder tube, stock, and bearing assembly for use in coordination with the existing equipment. Some of the reasons these alternate arrangements may be necessitated are pre-existing field conditions, limited space, and the rearward hull geometry. Therefore, this disclosure contemplates multiple arrangements, configurations, and uses.

Figure 12:
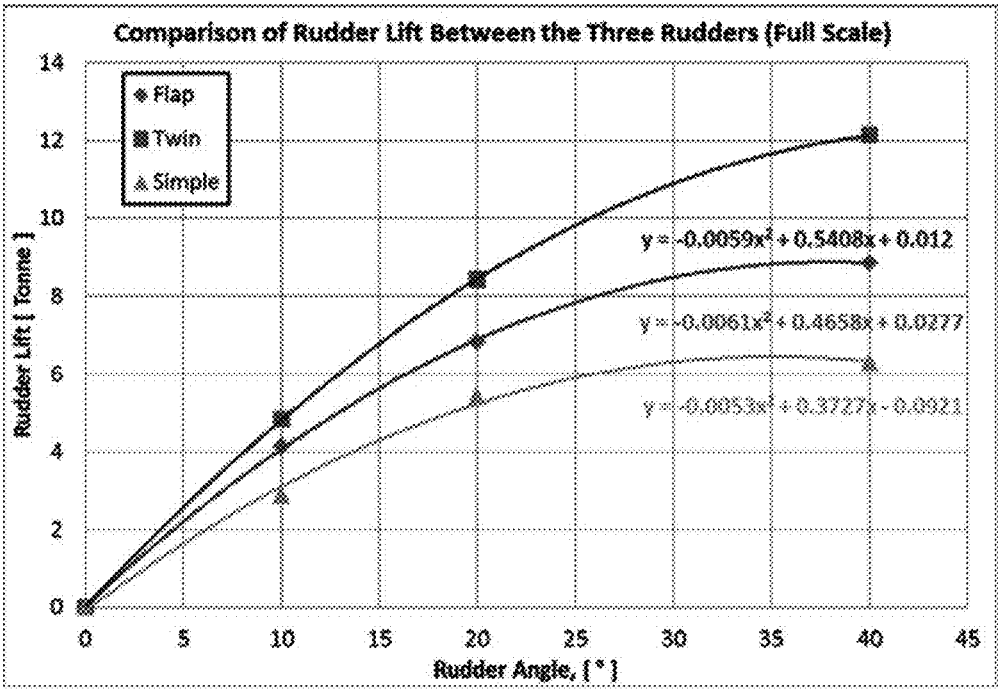
FIG. 12 is a graph showing a prediction of lift of three rudder systems at varied rudder angles.

FIG. 12 is a graph showing a prediction of lift of three rudder systems at varied rudder angles. It is noted that the predicted lift generated by the twin rudder system was 37%, 23%, and 17% higher than that of the flap rudder system at 40°, 20°, and 10° rudder angles, respectively. The dual rudder system 2 has been shown to have superior rudder lift under testing when compared to a simple rudder system and a single flapped rudder system. Additionally, the twin differential rudder system 2 has been shown to have superior drag, at the same rudder lift, under testing when compared to a simple rudder systems and a single flapped rudder systems.

As show by FIG. 12 the hydrodynamic efficiency of a dual rudder system 2, as may be disclosed herein, is superior to simple rudder systems, and single flapped rudder systems. The inventor has discovered through testing hydrodynamic properties including lift, drag, and total steering moment, that the dual rudder system 2 shows improved and unexpected properties associated with the invention design. The dual rudder system 2 is capable of providing the same steering forces as the rudder arrangements of existing pushboats, towboats, and tugboats at lower rudder angles and reduced drag. Therefore, the dual rudder system 2 may result in significant improvements of navigability and efficiency.

While illustrative embodiments have been described herein, the scope includes any and all embodiments having equivalent elements, modifications, omissions, combinations (e.g., of aspects across various embodiments), adaptations or alterations based on the present disclosure. The elements in the claims are to be interpreted broadly based on the language employed in the claims and not limited to examples described in the present specification or during the prosecution of the application, which examples are to be construed as non-exclusive. It is intended, therefore, that the specification and examples be considered as example only, with a true scope and spirit being indicated by the following claims and their full scope of equivalents.

What is claimed is:

1. A dual differential rudder system for steering a marine vehicle, the rudder system comprising:

a port side differential rudder system comprising:

a port side upper linkage assembly bar;

a port side lower linkage assembly bar;

a port side outside rudder; and a port side inside rudder;

a starboard side differential rudder system comprising:

a starboard side upper linkage assembly bar;

a starboard side lower linkage assembly bar;

a starboard side outside rudder; and a starboard side inside rudder, wherein the port side differential rudder system is configured to turn the port side outside rudder at a different angle than the port side inside rudder angle, and the starboard side differential rudder system is configured to turn the starboard side outside rudder at a different angle than the starboard side inside rudder angle.

2. The dual differential rudder system of claim 1, wherein:

the port side upper linkage assembly bar is coupled to a port side control arm and a port side outside linkage control member, and the port side outside linkage control member is coupled to a port side outside bearing assembly;

the port side lower linkage assembly bar is coupled to the port side outside linkage control member and the port side inside linkage control member, and the port side inside linkage control member is coupled to a port side inside bearing assembly;

the port side outside rudder is coupled to the port side outside bearing assembly; and the port side inside rudder is coupled to the port side inside bearing assembly, wherein:

the starboard side upper linkage assembly bar is coupled to a starboard side control arm and a starboard side outside linkage control member, and the starboard side outside linkage control member is coupled to a starboard side outside bearing assembly;

the starboard side lower linkage assembly bar is coupled to the starboard side outside linkage control member and a starboard side inside linkage control member, and the starboard side inside linkage control member is coupled to a starboard side inside bearing assembly;

a starboard side outside rudder coupled to the starboard side outside bearing assembly; and a starboard side inside rudder coupled to the starboard side inside bearing assembly.

3. The dual differential rudder system of claim 2, wherein the port side outside rudder is configured to turn, relative to a neutral position, at the same angle as the starboard side inside rudder and the port side inside rudder is configured to turn at the same angle as starboard side outside rudder.

4. The dual differential rudder system of claim 2, wherein, in a hard left turning position, the port side outside rudder is configured to turn, relative to a neutral position, at about 36 degrees, the port side inside rudder is configured to turn, relative to a neutral position, at about 44 degrees, the starboard side inside rudder is configured to turn, relative to a neutral position, at about 36 degrees, and the starboard side outside rudder is configured to turn, relative to a neutral position, at about 44 degrees.

5. The dual differential rudder system of claim 2, wherein:

the port side upper linkage assembly bar is substantially equal in length to the shortest distance from a centerline of the port side control arm to the axis of rotation of the port side outside bearing assembly; and the starboard side upper linkage assembly bar is substantially equal in length to the shortest distance from a centerline of the starboard side control arm to the axis of rotation of the starboard side inside bearing assembly.

6. The dual differential rudder system of claim 5, wherein:

the port side upper linkage assembly bar projects away from a centerline of the modified marine vehicle and the starboard side upper linkage assembly bar projects towards the centerline of the modified marine vehicle.

7. The dual differential rudder system of claim 2, wherein:

the port side lower linkage assembly bar is greater in length than the shortest distance from an axis of rotation of the port side inside bearing assembly to an axis of rotation of the port side outside bearing assembly; and the starboard side lower linkage assembly bar is greater in length than the shortest distance from an axis of rotation of the starboard side inside bearing assembly to an axis of rotation of the starboard side outside bearing assembly.

8. The dual differential rudder system of claim 7, wherein:

the port side outside control member is angled away from a centerline of the modified marine vehicle, and the port side inside control member is angled toward the centerline of the modified marine vehicle; and the starboard side outside control member is angled away from the centerline of the modified marine vehicle, and the port side inside control member is angled toward the centerline of the modified marine vehicle.

9. The dual differential rudder system of claim 7, further comprising a port side trimmed and capped rudder tube assembly and a starboard side trimmed and capped rudder tube assembly, each of the assemblies corresponding to a modified pre-existing rudder tube assembly, respectively.

10. The dual differential rudder system of claim 9, further comprising:

a port side tiller arm that is coupled to the port side trimmed and capped rudder tube assembly and a port side outside rudder tube assembly; and a starboard side tiller arm that is coupled to the starboard side trimmed and capped rudder tube assembly and a starboard side inside rudder tube assembly.

11. The dual differential rudder system of claim 10, further comprising:

a port side inside rudder tube assembly;

a starboard side outside tube assembly, wherein the port side outside rudder tube assembly and the port side inside rudder tube assembly are evenly spaced apart from the port side trimmed and capped rudder tube assembly at equal distances, respectively; and the starboard side outside rudder tube assembly and the starboard side inside rudder tube assembly are evenly spaced apart from the starboard side trimmed and capped rudder tube assembly at equal distances, respectively.

12. The dual differential rudder system of claim 1, wherein the marine vehicle is chosen from a Pushboat, Towboat, and Tugboat.

13. A dual differential rudder system, the rudder system comprising:

a port side differential rudder system, including:

a port side control arm, the port side control arm being coupled to a port side outside bearing assembly;

a port side lower linkage assembly bar coupled to a port side outside linkage control member and a port side inside linkage control member, the port side inside linkage control member being coupled to a port side inside bearing assembly;

a port side outside rudder coupled to the port side outside bearing assembly; and a port side inside rudder coupled to the port side inside bearing assembly;

a starboard side differential rudder system, including:

a starboard side control arm, the starboard side control arm being coupled to a starboard side outside bearing assembly, a starboard side lower linkage assembly bar coupled to the starboard side outside linkage control member and a starboard side inside linkage control member, the starboard side inside linkage control member being coupled to a starboard side inside bearing assembly;

a starboard side outside rudder coupled to the starboard side outside bearing assembly; and a starboard side inside rudder coupled to the starboard side inside bearing assembly, wherein the port side differential rudder system is configured to turn the port side outside rudder at a different angle than the port side inside rudder angle; and the starboard side differential rudder system is configured to turn the starboard side outside rudder at a different angle than the starboard side inside rudder angle.

14. The dual differential rudder system of claim 13, wherein the port side outside rudder is configured to turn at the same angle as the starboard side inside rudder and the port side inside rudder is configured to turn at the same angle as starboard side outside rudder.

15. The dual differential rudder system of claim 14, wherein, in a hard left turning position, the port side outside rudder is configured to turn, relative to a neutral position, at about 36 degrees, the port side inside rudder is configured to turn, relative to a neutral position, at about 44 degrees, the starboard side inside rudder is configured to turn, relative to a neutral position, at about 36 degrees, and the starboard side outside rudder is configured to turn, relative to a neutral position, at about 44 degrees.

16. The dual differential rudder system of claim 13, wherein:

the port side lower linkage assembly bar is greater in length than the shortest distance from an axis of rotation of the port side inside bearing assembly to an axis of rotation of the port side outside bearing assembly; and the starboard side lower linkage assembly bar is greater in length than the shortest distance from an axis of rotation of the starboard side inside bearing assembly to an axis of rotation of the starboard side outside bearing assembly.

17. The dual differential rudder system of claim 16, wherein:

the port side outside control member is angled away from a centerline of the modified marine vehicle, and the port side inside control member is angled toward the centerline of the modified marine vehicle; and the starboard side outside control member is angled away from the centerline of the modified marine vehicle, and the port side inside control member is angled toward the centerline of the modified marine vehicle.

18. The dual differential rudder system of claim 13, wherein the marine vehicle is chosen from a Pushboat, Towboat, and Tugboat.

19. A method of installing a dual differential rudder system on a marine vehicle, the method comprising:

removing and/or repairing at least a portion of a pre-existing rudder system;

reusing at least a portion of a pre-existing steering system, the portion including a pair of control arms, and a pair of hydraulic arms;

installing at least four new bearing assemblies and at least four rudder tubes;

attaching at least four new rudder stocks and at least four new rudders; and coupling a starboard side steering control assembly and a port side steering control assembly.

20. The method of claim 19, wherein the marine vehicle is chosen from a Pushboat, Towboat, and Tugboat, and wherein coupling the steering control assemblies further comprises:

connecting at least one new upper linkage assembly bar to a pre-existing control arm by a first connection, wherein the first connection is a freely rotating pinned connection; and connecting at least one lower linkage assembly bar to a pair of bearing assemblies by a second connection, wherein the second connection is a freely rotating pinned connection.

* * * * *